US009888538B2

(12) United States Patent
Niikura et al.

(10) Patent No.: US 9,888,538 B2
(45) **Date of Patent: *Feb. 6, 2018**

(54) DRIVING CURRENT GENERATION CIRCUIT, LED POWER SUPPLY MODULE AND LED LAMP

(71) Applicant: Rohm Co., Ltd., Kyoto (JP)

(72) Inventors: Eiichiro Niikura, Kyoto (JP); Kazuaki Kitaga, Kyoto (JP); Satoshi Yamada, Kyoto (JP); Masamichi Iwaki, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 152 days.

This patent is subject to a terminal disclaimer.

(21) Appl. No.: 14/943,140

(22) Filed: Nov. 17, 2015

(65) Prior Publication Data

US 2016/0073463 A1 Mar. 10, 2016

Related U.S. Application Data

(63) Continuation of application No. 13/540,806, filed on Jul. 3, 2012, now Pat. No. 9,220,134.

(30) Foreign Application Priority Data

Jul. 4, 2011 (JP) ..... 2011-148366
Nov. 17, 2011 (JP) ..... 2011-251290

(51) Int. Cl.
*H05B 33/08* (2006.01)

(52) U.S. Cl.
CPC ..... *H05B 33/0845* (2013.01); *H05B 33/0815* (2013.01)

(58) Field of Classification Search
None
See application file for complete search history.

(56) References Cited

U.S. PATENT DOCUMENTS 6,069,451 A 5/2000 Hush et al.
9,220,134 B2 * 12/2015 Niikura ..... H05B 33/0815
2012/0032605 A1 2/2012 Peng

FOREIGN PATENT DOCUMENTS

JP 2010-110157 5/2010

* cited by examiner

*Primary Examiner* — Dedei K Hammond
(74) *Attorney, Agent, or Firm* — Fish & Richardson P.C.

(57) ABSTRACT

A driving current generation circuit includes a semiconductor device configured to operate with a variable voltage as a reference voltage, a driving current generator configured to generate a driving current for driving an LED (Light Emitting Diode) based on an instruction received from the semiconductor device, and a dimming voltage converter configured to generate a second dimming voltage set based on the variable voltage from a first dimming voltage set based on a ground voltage, wherein the semiconductor device performs a driving control of the driving current generator based on the second dimming voltage.

16 Claims, 11 Drawing Sheets

DRIVING CURRENT GENERATION CIRCUIT, LED POWER SUPPLY MODULE AND LED LAMP

CROSS-REFERENCE TO RELATED APPLICATIONS

This application is a continuation of U.S. application Ser. No. 13/540,806, filed Jul. 3, 2012, which claims the benefit of priority from Japanese Patent Applications No. 2011-148366, filed on Jul. 4, 2011, and 2011-251290, filed on Nov. 17, 2011, the entire contents of which are incorporated herein by reference.

TECHNICAL FIELD

The present disclosure relates to a driving current generation circuit for generating driving current of light emitting diodes (LEDs) and an LED power supply module and an LED lamp including the same.

BACKGROUND

In recent years, as substitutes for conventional incandescent lamps and fluorescent lamps, LED lamps (in the form of incandescent bulb, fluorescent bulb, ceiling light and the like) have been widely used because of their high durability and low power consumption characteristics.

In connection with the above types of lamps, some techniques for providing DC power supplies and LED lamps using the DC power supplies are disclosed in the related art.

However, the above techniques have several problems to be overcome to realize compactness and slimness of LED lamps, in particular, compactness and slimness of power supply modules configured to supply an electric power to LEDs.

SUMMARY

The present disclosure provides some embodiments of a driving current generation circuit that can be used in implementing an LED lamp, and an LED power supply module and an LED lamp of a compact and slim size.

According to a first aspect of the present disclosure, there is provided a driving current generation circuit including: a semiconductor device configured to operate with a variable voltage as a reference voltage; a driving current generator configured to generate, based on an instruction received from the semiconductor device, a driving current for driving an LED; and a dimming voltage converter configured to generate a second dimming voltage set based on the variable voltage from a first dimming voltage set based on a ground voltage, wherein the semiconductor device performs a driving control of the driving current generator based on the second dimming voltage.

In some embodiments, the dimming voltage converter includes: a voltage/current converter configured to convert the first dimming voltage into a dimming current; and a current/voltage converter configured to convert the dimming current into the second dimming voltage.

In some embodiments, the voltage/current converter includes a current mirror configured to mirror a current flowing at an input side of the current mirror to generate a dimming current at an output side of the current mirror based on a difference between a constant voltage and the first dimming voltage.

In some embodiments the current/voltage converter includes a resistor connected between an application terminal of the second dimming voltage and an application terminal of the variable voltage to flow the dimming current flowing therethrough.

In some embodiments, the dimming voltage converter is further configured to generate the second dimming voltage such that the second dimming voltage remains on or above a threshold voltage as long as the first dimming voltage is set to be within an LED dimming voltage range, and the threshold voltage is a voltage below which the driving current is not variably controlled based on the second dimming voltage by the semiconductor device.

In some embodiments, the dimming voltage converter is further configured to generate the second dimming voltage such that the second dimming voltage becomes zero when the first dimming voltage is set to an LED off voltage.

In some embodiments, the driving current generator includes: a transistor having a drain connected to an application terminal of an input voltage, a source connected to an application terminal of a driving current detecting voltage, and a gate connected to an application terminal of a gate voltage; a driving current detecting resistor having a first terminal connected to the source of the transistor and a second terminal connected to an application terminal of the variable voltage; an inductor having a first terminal connected to the application terminal of the variable voltage and a second terminal connected to an anode of the LED; a capacitor having a first terminal connected to the anode of the LED and a second terminal connected to a cathode of the LED; and a diode having a cathode connected to the source of the transistor and an anode connected to the cathode of the LED, wherein the semiconductor device provides, when generating the gate voltage such that the driving current detecting voltage matches a reference detecting voltage, an offset of the driving current detecting voltage or the reference detecting voltage from the second dimming voltage.

In some embodiments, the input voltage is a driving voltage of the semiconductor device.

According to a second aspect of the present disclosure, there is provided an LED power supply module mounted on a printed circuit board, the LED power supply module including: a filter configured to remove noises and surges superposed on an AC input voltage; an AC/DC converter configured to convert the AC input voltage into a first DC voltage; a power factor correction circuit configured to perform a power factor correction and boosts the first DC voltage to generate a second DC voltage; a DC/DC converter configured to drop the second DC voltage to generate a third DC voltage; and the driving current generation circuit of the first aspect of the present disclosure, wherein the driving current generation circuit receives the third DC voltage as the input voltage.

In some embodiments, the DC/DC converter includes a transformer.

In some embodiments, the transformer has wiring terminals winding pins extending horizontally with respect to the printed circuit board.

In some embodiments, the transformer has terminal pins extending vertically with respect to the printed circuit board.

In some embodiments, the wiring terminal winding pins and the terminal pins are formed integratedly into L-shape conductive members.

In some embodiments, the wiring terminal winding pins project from side surfaces of a base of the transformer, and wiring terminals are wound around the wiring terminal winding pins through grooves formed at the side surface of the base.

In some embodiments, the wiring terminals start to be wound around the wiring terminal winding pins from the outermost wiring terminal winding pins.

According to a third aspect of the present disclosure, there is provided an LED lamp including: LED modules; and the LED power supply module of the second aspect of the present disclosure, wherein the LED power supply module supplies an electric power to the LED modules.

In some embodiments, the LED lamp further includes: a control power supply module configured to output the first dimming voltage to the LED power supply module; and a remote controller signal receiving module configured to receive a remote controller signal from a remote controller and transmit the received remote controller signal to the control power supply module, wherein the control power supply module is configured to output the first dimming voltage according to the remote controller signal.

In some embodiments, the LED lamp further includes a cover configured to accommodate therein the LED modules, the LED power supply module, the control power supply module and the remote controller signal receiving module.

In some embodiments, the LED modules are arranged according to a shape of the cover.

In some embodiments, the cover is a circular member, and the LED power supply module, the control power supply module and the remote controller signal receiving module are arranged at a more inner side of the cover than the LED modules are.

In some embodiments, the LED modules are classified into a plurality of groups based on luminescence colors of the LED modules, and the LED power supply module includes LED power supply sub-modules configured to supply electric powers to the plurality of the groups, the groups and the LED-power supply sub-modules being in one-to-one correspondence.

In some embodiments, the control power supply module includes: a microcomputer configured to control reception of the remote controller signal and generation of the first dimming voltage; a microcomputer power supply configured to convert the AC input voltage into a DC voltage and supplies the converted DC voltage to the microcomputer; and an output capacitor connected to an output terminal of the microcomputer power supply.

In some embodiments, the LED lamp further includes a relay switch configured to connect or disconnect between an application terminal of the AC input voltage and the LED power supply module, and when turning off the LED, the microcomputer decreases the second dimming voltage to a lower limit of an LED dimming voltage range, variably controls the first dimming voltage such that the second dimming voltage becomes zero, and switches off the relay switch.

DETAILED DESCRIPTION

<LED Lamp>

Figure 1:
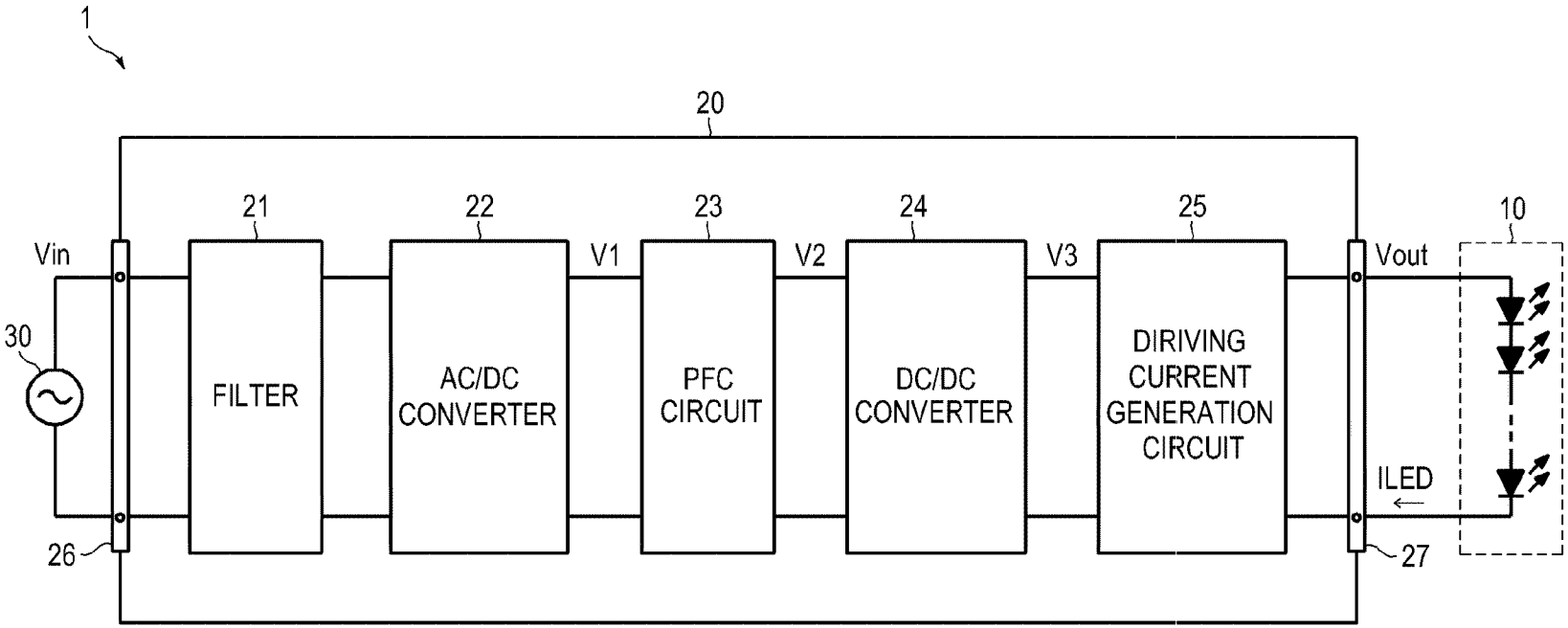
FIG. 1 is a block diagram showing an example configuration of an LED lamp.

FIG. 1 is a block diagram showing an example configuration of an LED lamp 1. In this configuration, the LED lamp 1 includes an LED module 10 and an LED power supply module 20.

The LED module 10 is a light source of the LED lamp 1 to emit light of daylight color (having a color temperature of about 5000 K) or electric bulb color (having a color temperature of about 3000 K) and includes a plurality of LED elements connected in series or in parallel.

The LED power supply module 20 converts an AC input voltage Vin, e.g., 80 V to 264 V, from a commercial AC power source 30 into a DC output voltage Vout, e.g., 60 V to 90 V, and supplies the DC output voltage Vout to the LED module 10. The LED power supply module 20 includes a filter 21, an AC/DC converter 22, a power factor correction (PFC) circuit 23, a DC/DC converter 24, a driving current generation circuit 25, an input connector 26 and an output connector 27, all of which are mounted on a printed wiring board.

The filter 21 serves to remove noises or surges superposed on the AC input voltage Vin.

The AC/DC converter 22 converts the AC input voltage Vin input through the filter 21 into a DC voltage V1, e.g., 113 V to 363 V.

The PFC circuit 23 performs a power factor correction and boosts the DC voltage V1 to generate a DC voltage V2, e.g., 400 V.

The DC/DC converter 24 drops the DC voltage V2 to generate a DC voltage V3, e.g., 110 V to 120 V.

The driving current generation circuit 25 receives the DC voltage V3 and performs a feedback control of a driving current ILED flowing through the LED module 10 such that the driving current ILED matches a predetermined target value. A circuit configuration of the driving current generation circuit 25 will be described in detail later.

The input connector 26 supplies the AC input voltage Vin from the commercial AC power source 30 to the filter 21.

The output connector 27 supplies the DC output voltage Vout, e.g., 60 V to 90 V, from the driving current generation circuit 25 to the LED module 10.

Figure 2:
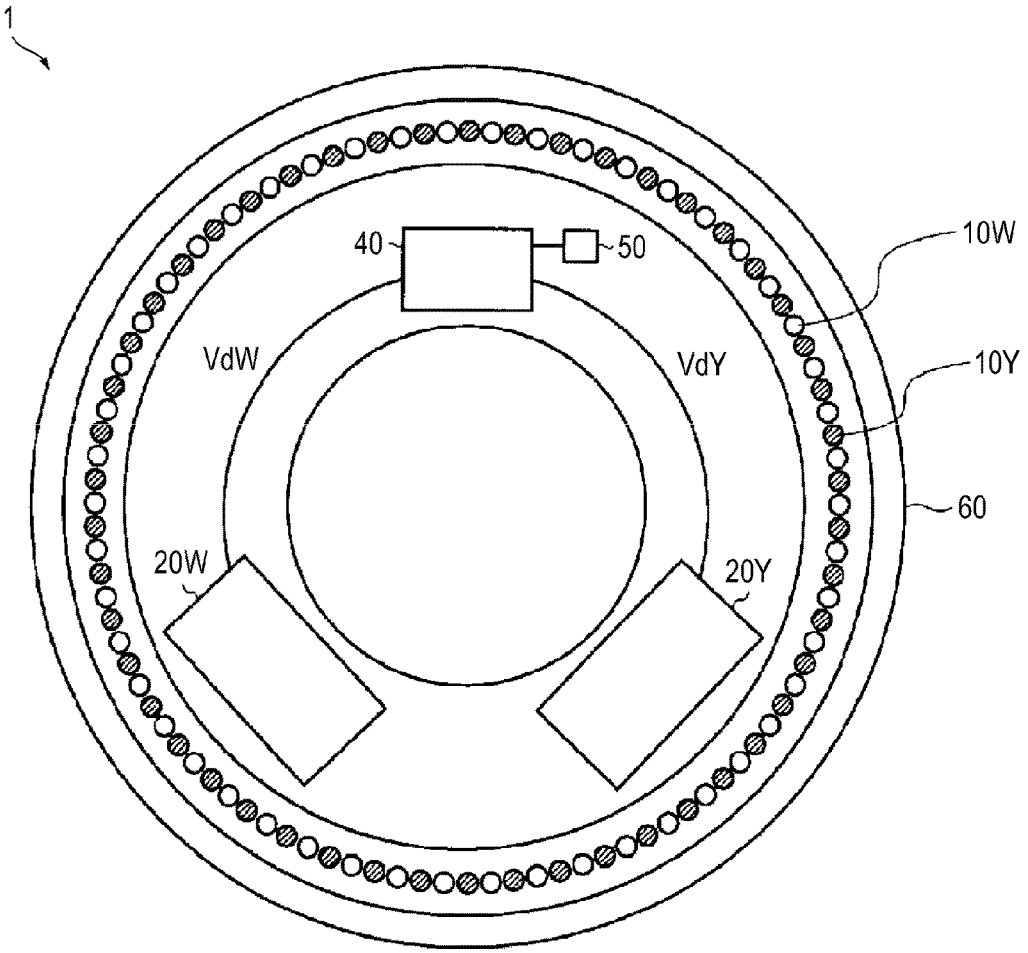
FIG. 2 is a view showing an example outward appearance of the LED lamp.

FIG. 2 shows an example outward appearance of the LED lamp 1. The LED lamp 1 shown in FIG. 2 is used as a ceiling light source and includes an LED module 10, an LED power supply module 20, a control power supply module 40, a remote controller signal receiving module 50 and a cover 60.

The LED module 10 includes daylight color LED modules 10W and electric bulb color LED modules 10Y. With this configuration including the LED modules 10W and 10Y having different luminescence colors, the overall light-tone control of the LED lamp 1 can be performed by performing a dimming control on each of the LED modules 10W and 10Y. Although it is shown in FIG. 2 that the LED modules 10W and the LED modules 10Y are alternately arranged along a single line according to the circular shape of the cover 60, the arrangement of the LED modules 10W and 10Y is not limited thereto.

The LED power supply module 20 includes an LED power supply module 20W configured to supply an electric power to the LED modules 10W and an LED power supply module 20Y configured to supply an electric power to the LED modules 10Y. Each of the LED power supply modules 20W and 20Y has the same configuration as shown in FIG. 1.

The control power supply module 40 outputs, based on a remote controller signal to be described below, dimming voltages VdW and VdY, e.g., 0 V to 5 V, to the LED power supply modules 20W and 20Y, respectively.

The remote controller signal receiving module 50 receives the remote controller signal, e.g., an infrared signal or a radio signal, from a remote controller (not shown) and transmits the remote controller signal to the control power supply module 40.

The cover 60 is a circular member accommodating therein the LED modules 10W and 10Y, the LED power supply modules 20W and 20Y, the control power supply module 40 and the remote controller signal receiving module 50. In the cover 60, the LED power supply modules 20W and 20Y, the control power supply module 40 and the remote controller signal receiving module 50 are arranged at a more inner side than where the LED modules 10W and 10Y are arranged.

<Driving Current Generation Circuit>

Figure 3:
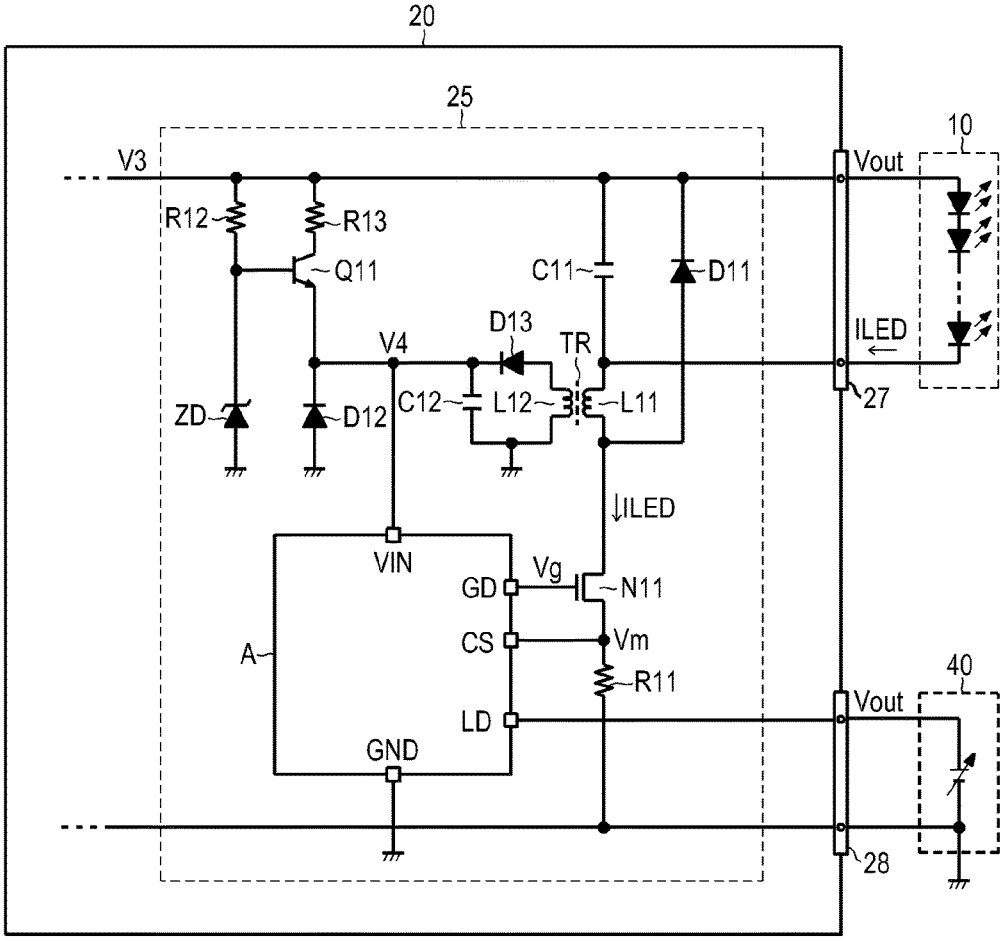
FIG. 3 is a circuit diagram of a first example configuration of a driving current generation circuit.

FIG. 3 is a circuit diagram showing a first example configuration of the driving current generation circuit 25. The driving current generation circuit 25 of the first example configuration includes a semiconductor device A, an N channel metal oxide semiconductor (MOS) field effect transistor N11, an npn bipolar transistor Q11, resistors R11 to R13, capacitors C11 and C12, diodes D11 to D13, a zener diode ZD and a transformer TR.

The application terminal of the DC voltage V3 is connected to a positive electrode terminal of the output connector 27, i.e., the anode of the LED module 10. A first terminal of the resistor R12 is connected to the application terminal of the DC voltage V3. A second terminal of the resistor R12 is connected to the base of the transistor Q11 and the cathode of the zener diode ZD. The anode of the zener diode ZD is connected to a ground terminal. A first terminal of the resistor R13 is connected to the application terminal of the DC voltage V3. A second terminal of the resistor R13 is connected to the collector of the transistor Q11. The emitter of the transistor Q11 is connected to a VIN terminal (a power input terminal) of the semiconductor device A. The cathode of the diode D12 is connected to the VIN terminal of the semiconductor device A. The anode of the diode D12 is connected to the ground terminal.

A first terminal of the capacitor C11 is connected to the positive electrode terminal of the output connector 27, i.e., the anode of the LED module 10. A second terminal of the capacitor C11 is connected to a negative electrode terminal of the output connector 27, i.e., the cathode of the LED module 10. A first terminal of a primary winding L11 of the transformer TR is connected to the negative electrode terminal of the output connector 27. A second terminal of the primary winding L11 is connected to the anode of the diode D11 and the drain of the transistor N11. The cathode of the diode D11 is connected to the positive electrode terminal of the output connector 27. A first terminal of a secondary winding L12 of the transformer TR is connected to the anode of the diode D13. A second terminal of the secondary winding L12 is connected to the ground terminal. The cathode of the diode D13 is connected to the VIN terminal of the semiconductor device A. The capacitor C12 is connected between the cathode of the diode D13 and the ground terminal.

The source of the transistor N11 is connected to the ground terminal via the resistor R11 and also connected to a CS terminal (a driving current detecting terminal) of the semiconductor device A. The gate of the transistor N11 is connected to a GD terminal (a gate driving terminal) of the semiconductor device A. A GND terminal (a ground terminal) of the semiconductor device A is connected to a negative electrode terminal (a ground terminal) of a dimming connector 28. An LD terminal (a linear dimming terminal) of the semiconductor device A is connected to a positive electrode terminal (an application terminal of a dimming voltage Vd) of the dimming connector 28.

The transistor N11 is a switching element configured to switch on/off an electric current path from the cathode of the LED module 10 to the ground terminal. The semiconductor device A performs a turning-on/off control of the transistor N11 such that a current flowing into the ground terminal via the transistor N11 and the resistor R11, i.e., the driving current ILED of the LED module 10, matches a predetermined value.

In more detail, the semiconductor device A performs a turning-on/off control of the transistor N11 (a generation control of a gate voltage Vg) such that a driving current detecting voltage Vm applied to the CS terminal matches a reference detecting voltage. At this time, the semiconductor device A provides an offset of the driving current detecting voltage Vm or the reference detecting voltage from the dimming voltage Vd applied to the LD terminal. This configuration facilitates a linear dimming control of the LED lamp 1 based on the dimming voltage Vd.

When the transistor N11 is turned on, the driving current ILED flows from the application terminal of the DC voltage V3 to the ground terminal via the LED module 10, the primary winding L11 of the transformer TR, the transistor N11 and the resistor R11. On the other hand, when the transistor N11 is turned off, the driving current ILED flows in a loop of the primary winding L11 of the transformer TR, the diode D11 and the LED module 10.

The transistor Q11, the resistors R12 and R13 and the zener diode ZD together serve as a simple regulator (an emitter follower) which receives, when the semiconductor device A is turned on, a charging current of the capacitor C12 from the application terminal of the DC voltage V3 and generates a power source voltage V4 of the semiconductor device A. The transformer TR supplies an electric power to the semiconductor device A by using the driving current ILED flowing through the LED module 10. Accordingly, after the semiconductor device A is turned on, the capacitor C12 is charged along the current path from the secondary winding L12 of the transformer TR via the diode D13 and thus the electric power is continuously supplied to the semiconductor device A. The winding ratio of the transformer TR may be properly set in consideration of the power source voltage V4 required to operate the semiconductor device A.

In the driving current generation circuit 25 of the first example configuration, the semiconductor device A operates with the ground voltage applied to the GND terminal, i.e., 0 V, as a reference voltage. Accordingly, a device withstanding voltage of the semiconductor device A is required to be designed in consideration of an inter-terminal voltage applied between the VIN terminal and the GND terminal. If the DC voltage V3, e.g., 110 V to 120 V, is applied to the VIN terminal, the semiconductor device A should have a high withstand voltage, which may result in a large size of the semiconductor device A. However, since the driving current generation circuit 25 of the first example configuration is provided with a discrete power supply circuit (formed with the transistor Q11, the resistors R12 and R13, the diode D12, the zener diode ZD and the transformer TR) configured to generate the power source voltage V4, which is sufficiently lower than the DC voltage V3, e.g., about 5 V, the semiconductor device A can have a low withstanding voltage. Accordingly, in the first configuration, the size of the semiconductor device A may be reduced.

Figure 4:
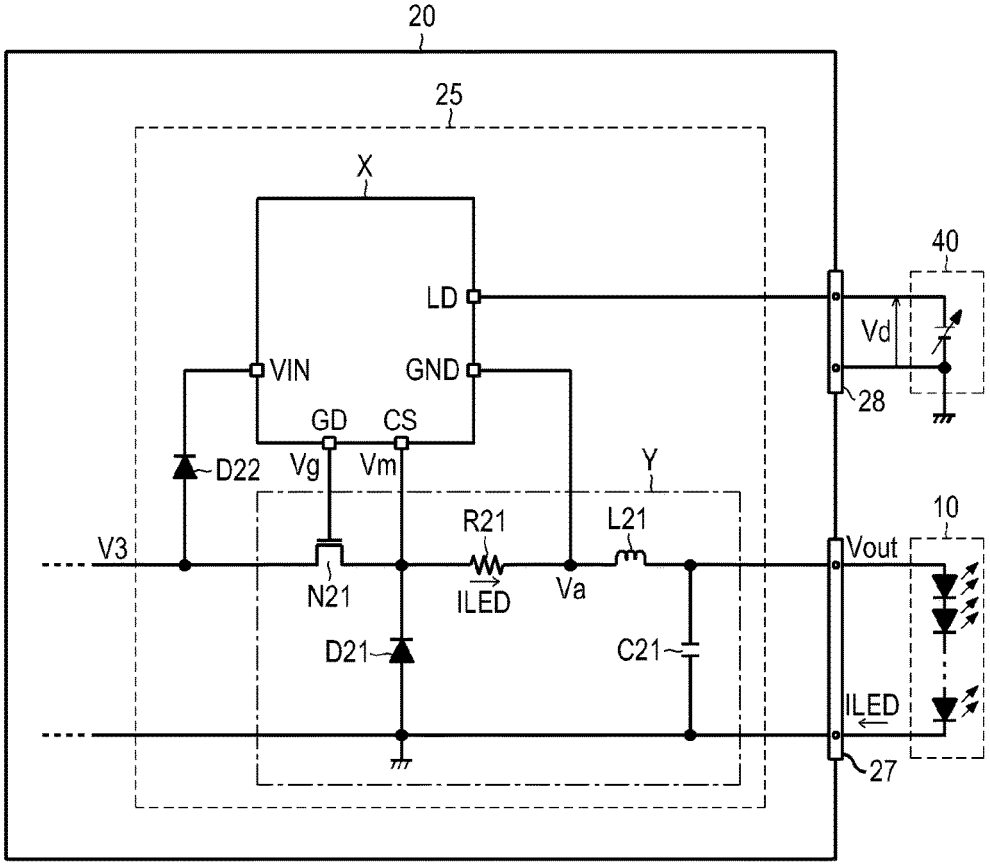
FIG. 4 is a circuit diagram of a second example configuration of the driving current generation circuit.

FIG. 4 is a circuit diagram showing a second example configuration of the driving current generation circuit 25. The driving current generation circuit 25 of the second example configuration includes a semiconductor device X, an N channel MOS field effect transistor N21, a resistor R21, an inductor L21, a capacitor C21 and diodes D21 and D22.

The drain of the transistor N21 is connected to an application terminal of the DC voltage V3. The source of the transistor N21 is connected to a first terminal of the resistor R21. The gate of the transistor N21 is connected to a GD terminal (a gate driving terminal) of the semiconductor device X. The first terminal of the resistor R21 is connected to a CS terminal (a driving current detecting terminal) of the semiconductor device X. A second terminal of the resistor R21 is connected to a GND terminal (a ground terminal) of the semiconductor device X. A first terminal of the inductor L21 is connected to the GND terminal of the semiconductor device X. A second terminal of the inductor L21 is connected to a positive electrode terminal of the output connector 27, i.e., the anode of the LED module 10. A first terminal of the capacitor C21 is connected to the positive electrode terminal of the output connector 27. A second terminal of the capacitor C21 is connected to a negative electrode terminal of the output connector 27. i.e., the cathode of the LED module 10. The cathode of the diode D21 is connected to the source of the transistor N21. The anode of the diode D21 is connected to the negative electrode terminal of the output connector 27. The cathode of the diode D22 is connected to a VIN terminal (a power source input terminal) of the semiconductor device X. The anode of the diode D22 is connected to the application terminal of the DC voltage V3. The negative electrode terminal of the output connector 27 is connected to the ground terminal. An LD terminal (a linear dimming terminal) of the semiconductor device X is connected to a positive electrode terminal (an application terminal of a dimming voltage Vd1) of a dimming connector 28. A negative electrode terminal of the dimming connector 28 is connected to the ground terminal.

In the second example configuration, the transistor N21, the resistor R21, the inductor L21, the capacitor C21 and the diode D21 together serve as a driving current generator Y configured to generate the driving current ILED of the LED module 10 based on an instruction from the semiconductor device X.

The transistor N21 is a switching element configured to switch on/off a current path from the application terminal of the DC voltage V3 to the anode of the LED module 10. The semiconductor device X performs a turning-on/off control of the transistor N21 such that a current flowing through the resistor R21, i.e., the driving current ILED of the LED module 10, matches a predetermined value.

In more detail, the semiconductor device X performs a turning-on/off control of the transistor N21 (a generation control of a gate voltage Vg) such that a driving current detecting voltage Vm applied to the CS terminal matches a reference detecting voltage.

When the transistor N21 is turned on, the driving current ILED flows from the application terminal of the DC voltage V3 to the ground terminal via the transistor N21, the resistor R21, the inductor L21 and the LED module 10. On the other hand, when the transistor N21 is turned off, the driving current ILED flows in a loop of the diode D21, the resistor R21, the inductor L21 and the LED module 10.

In the driving current generation circuit 25 of the second example configuration, a variable voltage Va, instead of the ground voltage, i.e., 0 V, is applied to the GND terminal of the semiconductor device X. The variable voltage Va is a voltage appearing on a connection node of the resistor R21 and the inductor L21 and varied with respect to the ground voltage, i.e., 0 V, depending on a switching operation of the transistor N21.

If the semiconductor device X operates with the variable voltage Va as a reference voltage, unlike the semiconductor device A, as shown in FIG. 3, which operates with the ground voltage, i.e., 0 V, as a reference voltage, an inter-terminal voltage applied between the VIN terminal and the GND terminal is not significantly increased even though the DC voltage V3 is applied to the VIN terminal, and thus the semiconductor device X does not need to have a high withstanding voltage. Accordingly, the driving current generation circuit 35 of the second example configuration may not include the discrete power supply circuit (formed with the transistor Q11, the resistors R12 and R13, the diode D12, the zener diode ZD and the transformer TR) shown in FIG. 3, thereby reducing the size of the driving current generation circuit 25 and making the LED power supply module 20 more compact.

Figure 5:
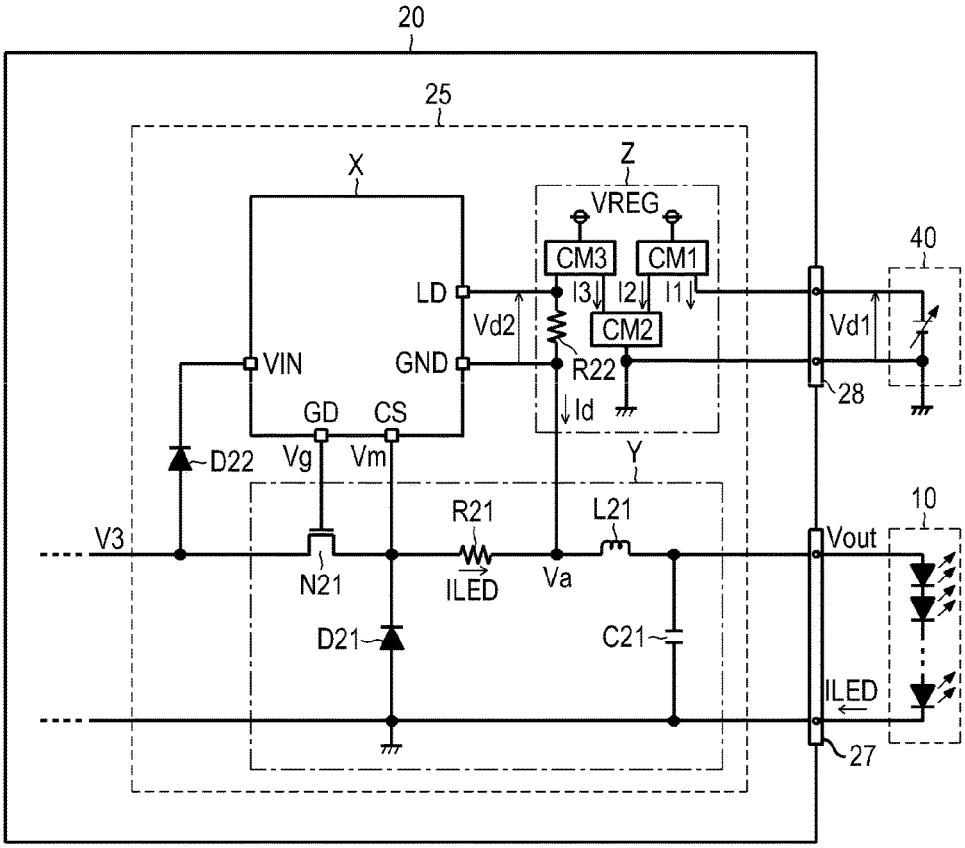
FIG. 5 is a circuit diagram of a third example configuration of the driving current generation circuit.

FIG. 5 is a circuit diagram showing a third example configuration of the driving current generation circuit 25. The driving current generation circuit 25 of the third example configuration is the same as that of the second example configuration except that the third example further includes a dimming voltage converter Z. In FIG. 5, the same elements of the third example configuration as those of the second configuration are denoted by the same reference numerals shown in FIG. 4, and therefore, an explanation of which will not be repeated. The following description is focused on characteristics of the third example configuration.

The dimming voltage converter Z is a circuit block configured to use a first dimming voltage Vd1 set based on the ground voltage, i.e., 0 V, to generate a second dimming voltage Vd2 set based on of the variable voltage Va. Further, the dimming voltage converter Z includes current mirrors CM1 to CM3 and a resistor R22.

The current mirror CM1 mirrors a current I1 flowing at its input side to generate a current I2 at its output side. The current mirror CM2 mirrors the current I2 flowing at its input side to generate a current I3 at its output side. The current mirror CM3 mirrors the current I3 flowing at its input side to generate a dimming current Id at its output side. If mirror ratios of the current mirrors CM1 to CM3 are all 1, a relationship of I1=I2=I3=Id is established. Here, the current I1 (=Id) varies depending on a difference between a constant voltage VREG, e.g., 5.6 V, applied to the current mirror CM1 and the first dimming voltage Vd1, e.g., 0 V to 5 V. In more detail, the current I1 is increased with a decrease of the first dimming voltage Vd1, whereas the current I1 is decreased with an increase of the first dimming voltage Vd1. That is, the current mirrors CM1 to CM3 together serve as a voltage/current converter to convert the first dimming voltage Vd1 into the dimming current Id.

The resistor R22 is connected between the LD terminal of the semiconductor device X (an application terminal of the second dimming voltage Vd2) and the GND terminal (an application terminal of the variable voltage Va) to flow the dimming current Id therethrough. As a result, the second dimming voltage Vd2 set, which varies depending on the dimming current Id, is applied to the LD terminal of the semiconductor device X. That is, the resistor R22 serves as a current/voltage converter to convert the dimming current Id into the second dimming voltage Vd2.

When the gate voltage Vg is generated to match the driving current detecting voltage Vm with a reference detecting voltage, the semiconductor device X provides an offset of the driving current detecting voltage Vm or the reference detecting voltage from the second dimming voltage Vds applied to the LD terminal. The second dimming voltage Vd2 is a voltage set based on the variable voltage Va while reflecting the first dimming voltage Vd1. Accordingly, in the semiconductor device X, the linear dimming control of the LED lamp 1 may be performed based on the second dimming voltage Vd2, and further, the first dimming voltage Vd1.

Figure 6A:
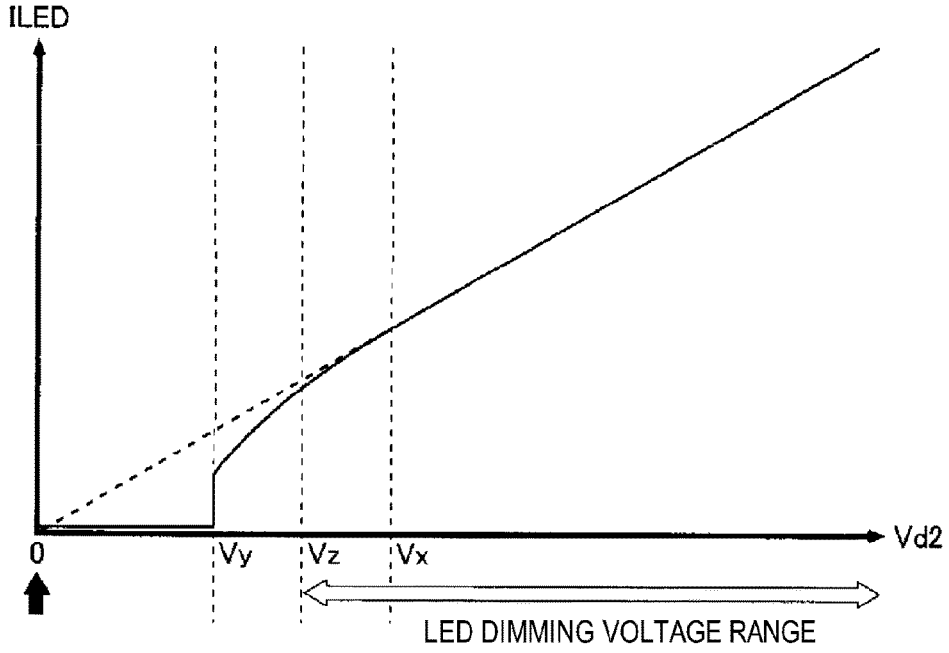
FIG. 6A is a view showing a correlation between a dimming voltage and a driving current.
Figure 6B:
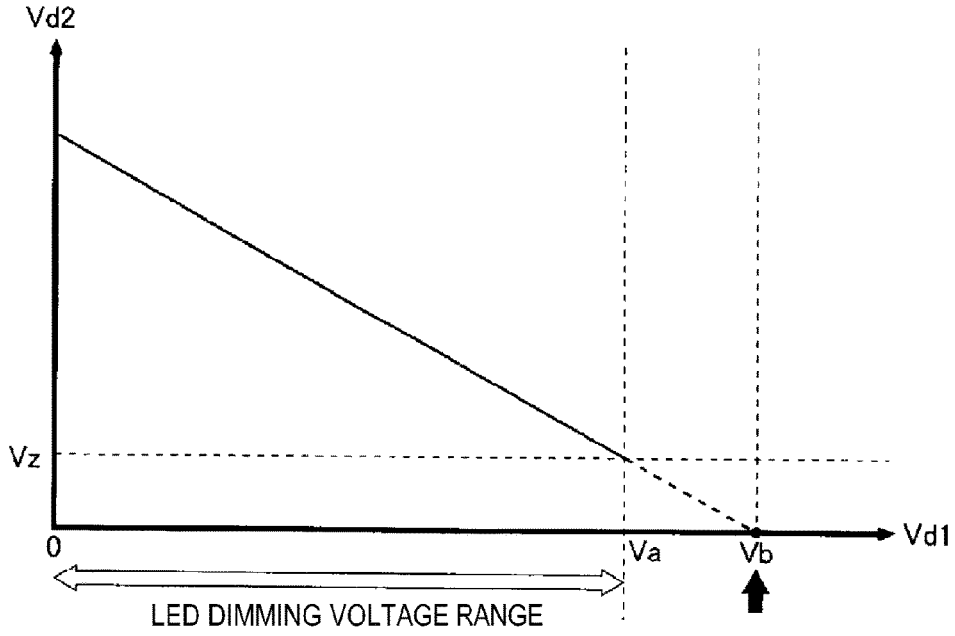
FIG. 6B is a view showing a correlation between the dimming voltage and another dimming voltage.

FIG. 6A shows a correlation between the second dimming voltage Vd2 and the driving current ILED and FIG. 6B shows a correlation between the first dimming voltage Vd1 and the second dimming voltage Vd2. As shown in FIG. 6A, in a region where the second dimming voltage Vd2 is higher than a threshold voltage Vx, the driving current ILED is controlled to vary linearly with respect to the second dimming voltage Vd2. In a region where the second dimming voltage Vd2 is lower than the threshold voltage Vx and higher than a threshold voltage Vy (Vy<Vx), the driving current ILED is controlled to vary nonlinearly with respect to the second dimming voltage Vd2.

On the other hand, in a region where the second dimming voltage Vd2 is lower than the threshold voltage Vy, the driving current ILED cannot be variably controlled based on the second dimming voltage Vd2 by the semiconductor device X, and as the driving current ILED, a minute current (about a few mA) which does not depend on the second dimming voltage Vd2 flows continuously. Under this condition, a flash effect in which the LED module 10 emits light with an unintended brightness due to charges remaining in an output capacitor (electrolytic capacitor) of the DC/DC conversion circuit 24 may occur.

Here, the dimming voltage converter Z is designed such that the second dimming voltage Vd2 does not fall below the threshold voltage Vy as long as the first dimming voltage Vd1 is set to be within an LED dimming voltage range, i.e., 0≤Vd1≤Va (see, white double-headed arrows in FIGS. 6A and 6B). That is, a lower limit Vz of the LED dimming voltage range set for the second dimming voltage Vd2 (see, the double-headed arrow in FIG. 6A) is set to be higher than the threshold voltage Vy. This setting can prevent the LED module 10 from undergoing the flash effect and can be realized by adjusting a current value of the current Id or a resistance of the resistor R22.

In addition, the dimming voltage converter Z is designed such that the second dimming voltage Vd2 becomes zero when the first dimming voltage Vd1 is set to an LED off voltage Vb (Vb>Va) (see, black arrows in FIGS. 6A and 6B). This setting can facilitate not only the dimming control but also the turning-off control of the LED module 10 by using the first dimming voltage Vd1.

However, if the second dimming voltage Vd2 is set to zero under the condition where the output capacitor of the DC/DC conversion circuit 24 is not sufficiently discharged, the LED module 10 may undergo the flash effect, as explained above. Further, since the minute current (about 1 mA) continues to flow as the driving current ILED even when the second dimming voltage Vd2 is set to zero, the LED module 10 cannot be completely turned off by only using the first dimming voltage Vd1.

Figure 7:
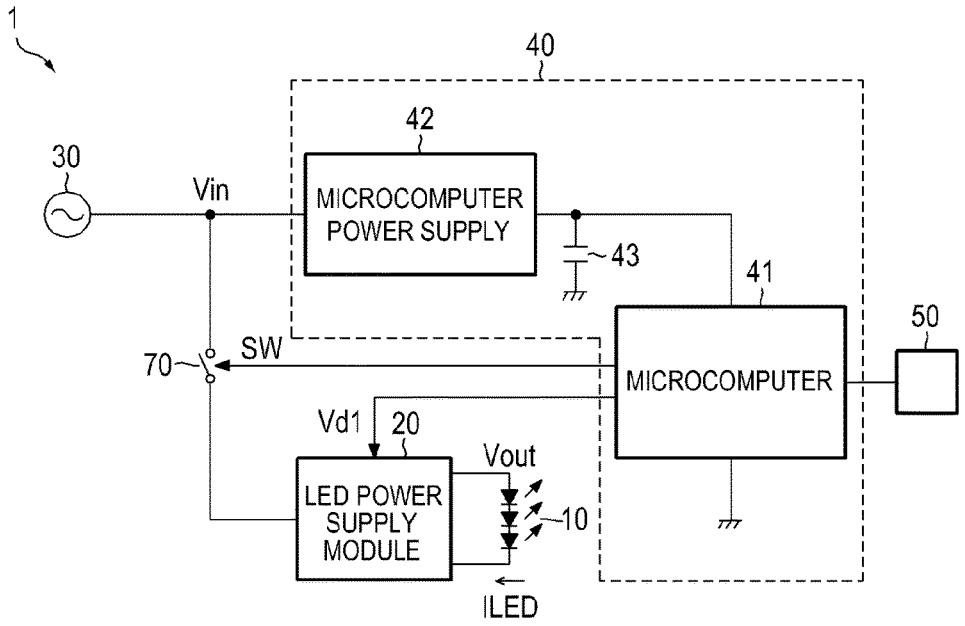
FIG. 7 is a block diagram showing a modification example of the LED lamp.

A configuration to overcome the above problem will be described in detail below with reference to FIG. 7. FIG. 7 is a block diagram showing a modification example of the LED lamp 1. The LED lamp 1 of this configuration further includes a relay switch 70 configured to electrically connect/disconnect between the commercial AC power source 30 (the application terminal of the AC input voltage Vin) and the LED power supply module 20, in addition to the LED module 10, the LED power supply module 20, the control power supply module 40 and the remote controller signal receiving module 50 which have been described in the above.

In the LED lamp 1 of this configuration, the control power supply module 40 includes a microcomputer 41, a microcomputer power supply 42 and an output capacitor 43. The microcomputer 41 controls a reception of a remote controller signal in the remote controller signal receiving module 50 and a generation of the first dimming voltage Vd1 supplied to the LED power supply module 20. The microcomputer power supply 42 converts the AC input voltage Vin into a DC voltage and supplies the DC voltage to the microcomputer 41. The output capacitor 43 is connected to an output terminal of the microcomputer power supply 42 to stabilize the DC voltage supplied to the microcomputer 41.

In the control power supply module 40 as configured above, when the LED module 10 is turned off according to the remote controller signal, the microcomputer 41 decreases the second dimming voltage Vd2 to the lower limit Vz of the LED dimming voltage range, variably controls the first dimming voltage Vd1 such that the second dimming voltage Vd2 becomes zero, and switches off the relay switch 70 by using a switch control signal SW.

With this configuration, since the driving current ILED can flow to discharge the output capacitor of the DC/DC converter 24 while decreasing the second dimming voltage Vd2 to the lower limit Vz for the LED dimming voltage range, the LED module 10 can be prevented from undergoing the flash effect when it is turned off. Further, since the relay switch 70 is finally switched off to cut off the supply of an electric power to the LED power supply module 20, the driving current ILED can be set to zero to completely turn off the LED module 10.

Further, in cutting off the commercial AC power source 30, if the microcomputer 41 is shut down earlier than the LED power supply module 20, the first dimming voltage Vd1 may become indefinite, which may cause the LED module 10 to undergo the flash effect. To avoid this, it is important to maintain the supply of an electric power to the microcomputer 41 by providing the output capacitor 43 with a sufficiently high capacitance so that the microcomputer 41 cannot be shut down earlier than the LED power supply module 20.

<DC/DC Converter>

The DC/DC converter 24 shown in FIG. 1 includes a transformer as a voltage transforming means. For the purpose of realizing slimness of the DC/DC converter 24 (further, slimness of the LED power supply module 20), it is important to form the transformer as thin as possible (less than 18 mm in height).

Figure 8:
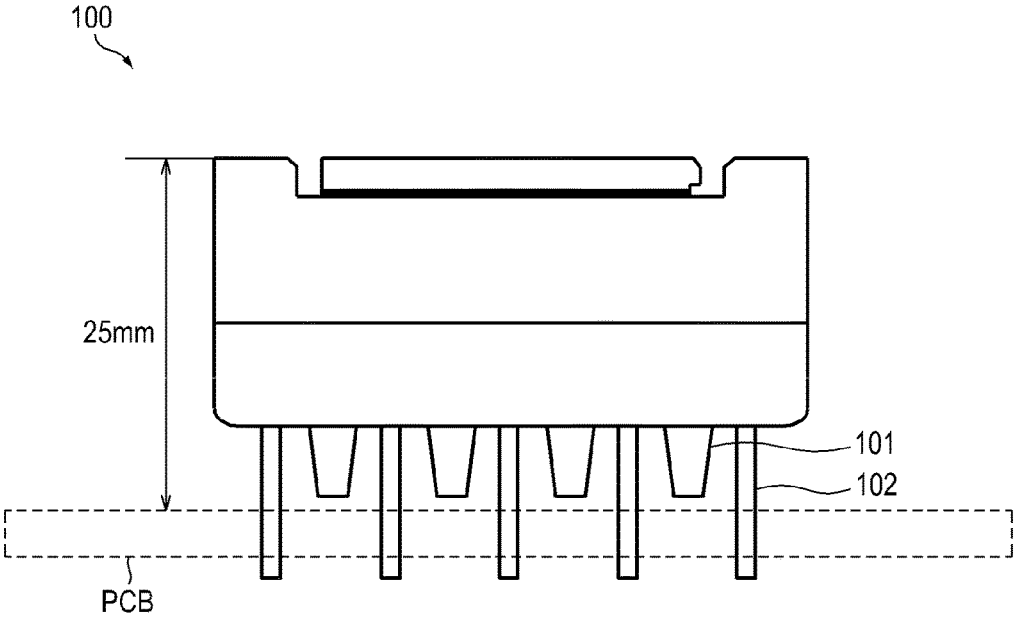
FIG. 8 (PRIOR ART)
FIG. 8 is a front view of a first example configuration of a transformer.

FIG. 8 is a front view of a first example configuration of a transformer 100 (a conventional general-purpose high output transformer). The transformer 100 includes terminal pins 101 and wiring terminal winding pins 102, all of which vertically extend from a printed circuit board PCB. The wiring terminal winding pins 102 need to have a specific length sufficient to wind winding terminals. Accordingly, the height of the transformer 100 (including the length of the wiring terminal winding pins 102) from the printed circuit board is about 25 mm. Therefore, the slimness of the LED power supply module 20 cannot be realized by using the transformer 100 as a voltage transforming means of the DC/DC converter 24.

In addition to the above-mentioned general-purpose high output transformer, a general-purpose thin transformer (12 mm in height) has been conventionally put in practical use. However, the general-purpose thin transformer can hardly pass a heat dissipation test because of its small effective sectional area. Accordingly, a transformer used as a voltage transforming means of the DC/DC converter 24 is expected to have a low height while maintaining the same effective sectional area to that of the conventional general-purpose high output transformer.

FIGS. 9 to 15 are a top view, a front view, a side view, a bottom view, a bottom sectional view, a front sectional view and a connection wiring diagram of a second example configuration of a transformer 200, respectively. As shown in these figures, the transformer 200 includes a gapless core 201A, a gap core 201B, a case 202A, a base 202B, a spacer 202C, terminal pins 203A, wiring terminal winding pins 203B, a primary winding 204, a secondary winding 205, insulating tapes 206, a core tape 207, surface tapes 208 and adhesives 209.

The gapless core 201A and the gap core 201B are configured to form a magnetic core of the transformer 200. An example of the gapless core 201A and the gap core 201B may include a ferrite core.

The case 202A, the base 202B and the spacer 202C are configured to form a bobbin of the transformer 200. These are made of, for example, phenol resin and formed integratedly in FIGS. 10 and 14. The case 202A is configured to accommodate therein the primary winding 204 and the secondary winding 205. The case 202A is disposed on the same plane as the gapless core 201A and a gap is provided between the gap core 201B and the case 202A in FIG. 13. The base 202B is configured to hold the terminal pins 203A and the wiring terminal winding pins 203B. The spacer 202C is configured to project from the bottom surface of the base 202B toward the printed circuit board PCB. This configuration of the spacer 202C can alleviate damage to the root of the terminal pins 203A when the transformer 200 is mounted on the printed circuit board PCB.

The terminal pins 203A are configured to make an electrical connection between the transformer 200 and the printed circuit board PCB. The terminal pins 203A project from the bottom surface of the base 202B in a direction extending vertically with respect to the printed circuit board PCB in FIGS. 10, 11, 12 and 13. The terminal pins 203A may be formed with, for example, copper plating pins.

The wiring terminal winding pins 203B are configured to wind therearound and solder thereto wiring terminals WT of the primary and the second winding 204 and 205. The wiring terminal winding pins 203B project from the side surface of the base 202B in a direction extending horizontally with respect to the printed circuit board PCB in FIGS. 9, 10, 11, 12 and 14. The wiring terminal winding pins 203B may be formed with, for example, copper plating pins, like the terminal pins 203A. This transformer 200 of the second example configuration can reduce its height to about 13 mm while maintaining the same effective sectional area to that of the transformer 100 of the first example configuration.

Figure 12:
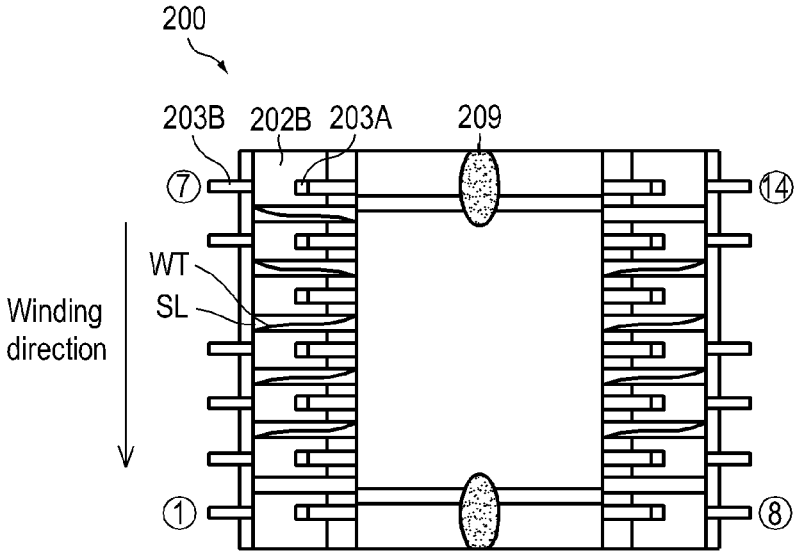
FIG. 12 is a bottom view of the second example configuration of the transformer.
Figure 13:
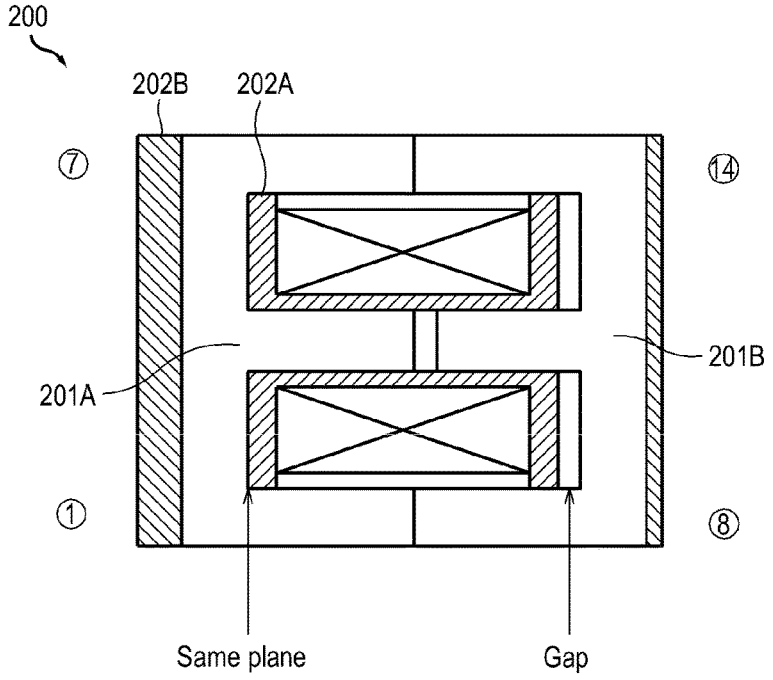
FIG. 13 is a bottom sectional view of the second example configuration of the transformer.

The wiring terminals WT are led outside the base 203B through grooves SL formed at the side surface of the base 203B and starts to be wound around the wiring terminal winding pins 203B from the outermost wiring terminal winding pins 203B, i.e., in a direction shown in FIG. 12. This configuration reduces a load applied to the primary and the secondary winding 204 and 205 during soldering. In some embodiments, the number of winding of the wiring terminals WT is more than one.

Figure 14:
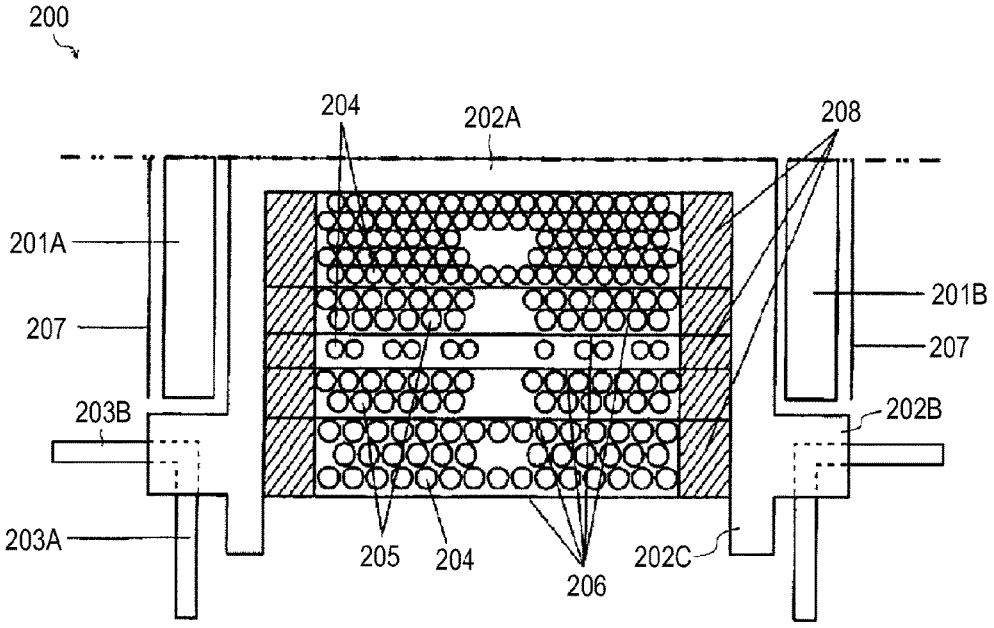
FIG. 14 is a front sectional view of the second example configuration of the transformer.

The terminal pins 203A and the wiring terminal winding pins 203B may be formed integratedly into L-shape conductive members, as shown in FIG. 14. Alternatively, the terminal pins 203A and the wiring terminal winding pins 203B may be separately prepared and electrically connected with each other by conductive members.

In the figures, seven terminal pins 203A and seven wiring terminal winding pins 203B are equi-spacedly disposed on each side surface of the base 202B, as shown as circled numerals 1 to 14 in the figures. Here, the pin No. 5 is cut.

Figure 15:
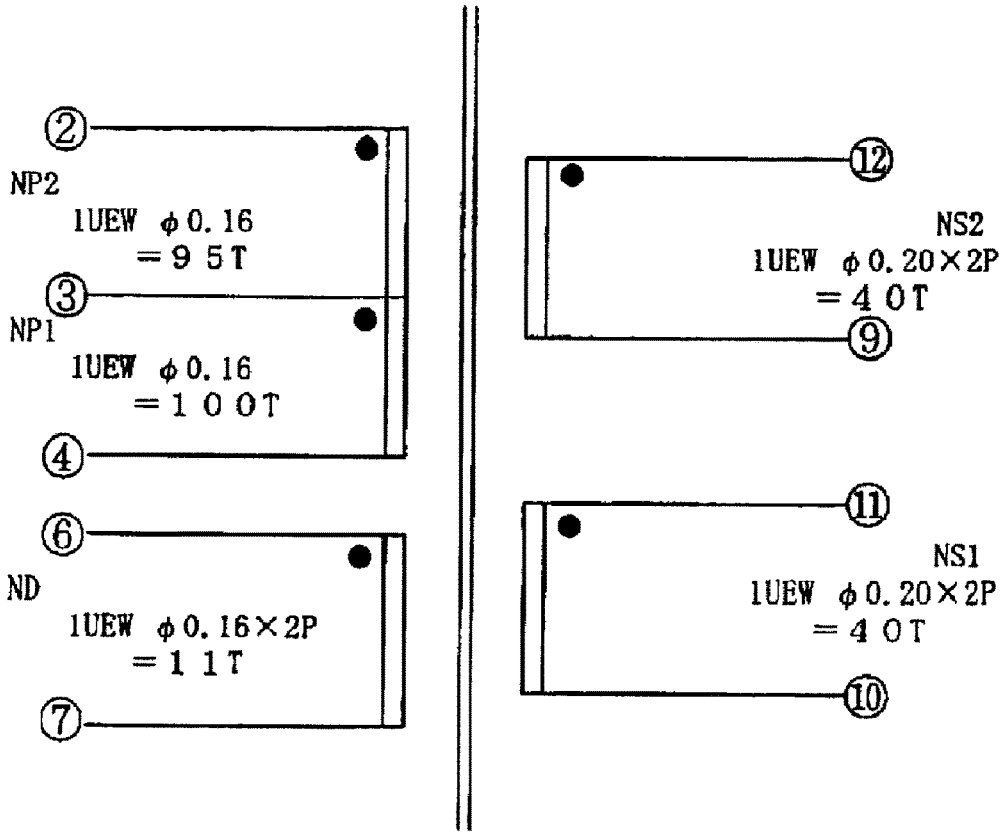
FIG. 15 is a connection wiring diagram of the second example configuration of the transformer.

The primary and the secondary winding 204 and 205 are configured to form coils NP1, NP2, ND, NS1 and NS2 of the transformer 200 in FIG. 15. The primary and the secondary winding 204 and 205 may be made of, for example, a polyurethane copper line. The primary winding 204 corresponds to the coils NP1, NP2 and ND and the secondary winding 205 corresponds to the coils NS1 and NS2. In some embodiments, the primary and the secondary winding 204 and 205 are formed in such a manner as windings thereof do not go below the bottom surface of the base 202B in FIG. 14.

The insulating tapes 206 are inter-coil/inter-layer insulating members. An example of the insulating tapes 206 may include polyester films in FIG. 14.

Figure 10:
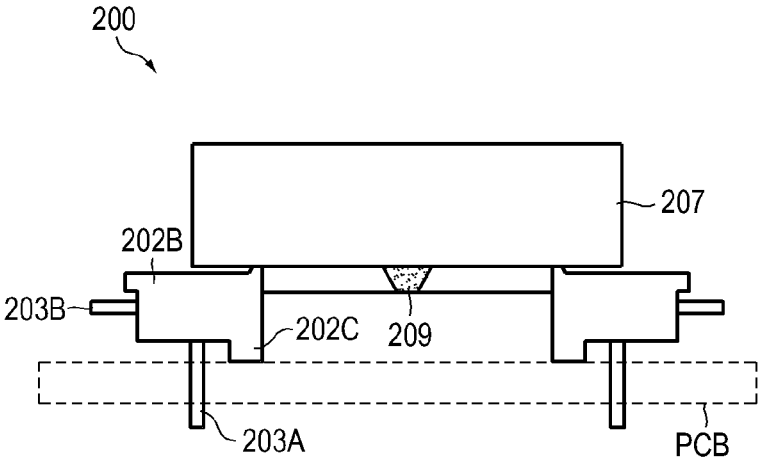
FIG. 10 is a front view of the second example configuration of the transformer.
Figure 11:
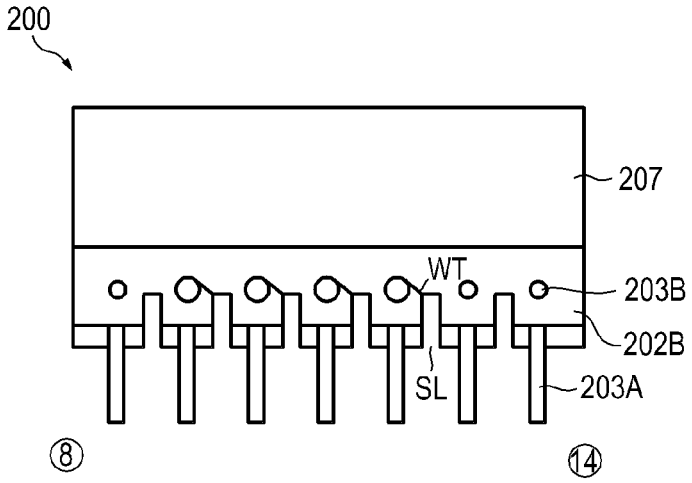
FIG. 11 is a side view of the second example configuration of the transformer.

The core tape 207 is configured to fasten the gapless core 201A and the gap core 201B together from outside of the gapless core 201A and the gap core 201B in FIGS. 10, 11 and 14. An example of the core tape 207 may include a polyester film. In some embodiments, the fastening by the core tape 207 is performed twice.

The surface tapes 208 are configured to coat the primary and the secondary winding 204 and 205 in FIG. 14. An example of the surface tapes 208 may include polyester films or polyester non-woven fabrics.

Figure 9:
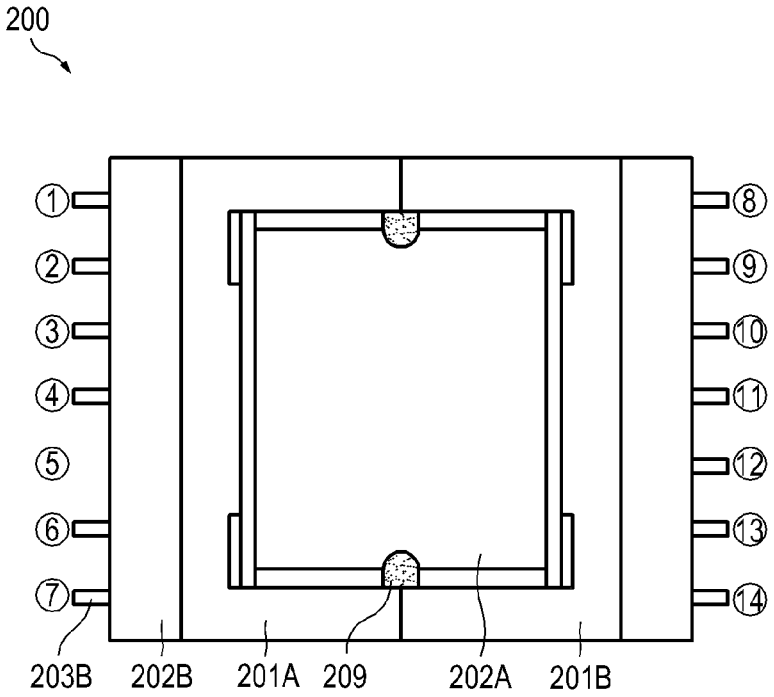
FIG. 9 is a top view of a second example configuration of a transformer.

The adhesives 209 are configured to fix contact surfaces of the gapless core 201A and the gap core 201B and coils (more precisely, the surface tapes 208) together at four sites in FIGS. 9, 10 and 12.

<Other Modification Examples>

Although it has been illustrated in the above embodiments that the spirit of the present disclosure is applied to the LED lamp used as a ceiling light source, the present disclosure is not limited thereto but may have wide applications as a technique to realize compactness and slimness of LED lamps (further, compactness and slimness of power supply modules).

The LED lamps according to the above embodiments of the present disclosure can be used as, for example, a ceiling light source and so on.

According to some embodiments of the present disclosure, it is possible to provide a driving current generation circuit capable of contributing to compactness and slimness of an LED lamp and an LED power supply module and an LED lamp including the same.

While certain embodiments have been described, these embodiments have been presented by way of example only, and are not intended to limit the scope of the disclosures. Indeed, the novel methods and apparatuses described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. A semiconductor device, which operates at a voltage level between a power source voltage and a first voltage lower than the power source voltage and controls a driving current for driving an LED (Light Emitting Diode), wherein the semiconductor device controls a level of the driving current based on a first dimming voltage, which is set based on the first voltage and an input from an external source, the first dimming voltage being converted from a second dimming voltage set based on a second voltage lower than the first voltage.

2. The semiconductor device of claim 1, wherein if the first dimming voltage is equal to or higher than a threshold voltage, the semiconductor device variably controls the level of the driving current based on the first dimming voltage.

3. The semiconductor device of claim 2, wherein the first dimming voltage remains equal to or higher than the threshold voltage, if the second dimming voltage is set to be within an LED dimming voltage range of equal to or higher than zero and equal to or lower than the first voltage.

4. The semiconductor device of claim 1, wherein the first dimming voltage becomes zero when the second dimming voltage is set to an LED off voltage higher than the first voltage.

5. The semiconductor device of claim 1, wherein the first voltage is a variable voltage and the second voltage is a ground voltage.

6. The semiconductor device of claim 1, wherein the semiconductor device generates a gate voltage to perform a turning-on and turning-off control of a switching element installed outside the semiconductor device, the switching element switching on a current path of the driving current to the LED when the gate voltage is applied to the switching element.

7. The semiconductor device of claim 6, wherein the semiconductor device performs the turning-on and turning-off control of the switching element such that a driving current detecting voltage matches a reference detecting voltage, the driving current being determined based on a difference between the driving current detecting voltage and the first voltage.

8. The semiconductor device of claim 7, wherein the semiconductor device provides an offset of the driving current detecting voltage or the reference detecting voltage from the first dimming voltage.

9. A semiconductor device, which operates at a voltage level between a power source voltage and a first voltage lower than the power source voltage and controls a driving current for driving an LED (Light Emitting Diode), comprising:

a power input terminal to which the power source voltage is applied;

a ground terminal to which the first voltage is applied;

a linear dimming terminal to which a first dimming voltage, which is set based on the first voltage and an input from an external source, is applied; and a control part that controls respective components of the semiconductor device to control a level of the driving current based on the first dimming voltage, the first dimming voltage being converted from a second dimming voltage set based on a second voltage lower than the first voltage.

10. The semiconductor device of claim 9, wherein if the first dimming voltage is equal to or higher than a threshold voltage, the control part variably controls the level of the driving current based on the first dimming voltage.

11. The semiconductor device of claim 10, wherein the first dimming voltage remains equal to or higher than the threshold voltage, if the second dimming voltage is set to be within an LED dimming voltage range of equal to or higher than zero and equal to or lower than the first voltage.

12. The semiconductor device of claim 9, wherein the first dimming voltage becomes zero when the second dimming voltage is set to an LED off voltage higher than the first voltage.

13. The semiconductor device of claim 9, wherein the first voltage is a variable voltage and the second voltage is a ground voltage.

14. The semiconductor device of claim 9, further comprising:

a gate driving terminal to which a gate voltage is applied, the gate driving terminal being connected to a switching element installed outside the semiconductor device, wherein the control part generates the gate voltage to perform a turning-on and turning-off control of the switching element, the switching element switching on a current path of the driving current to the LED when the gate voltage is applied to the switching element.

15. The semiconductor device of claim 14, further comprising:

a driving current detecting terminal to which a driving current detecting voltage is applied, the driving current being determined based on a difference between the driving current detecting voltage and the first voltage, wherein the control part performs the turning-on and turning-off control of the switching element such that the driving current detecting voltage matches a reference detecting voltage.

16. The semiconductor device of claim 15, wherein the control part provides an offset of the driving current detecting voltage or the reference detecting voltage from the first dimming voltage.

* * * * *